United States Patent [19]

Anderson

[11] Patent Number: 4,702,296

[45] Date of Patent: Oct. 27, 1987

[54] GLASS SPACER CONSTRUCTION

[75] Inventor: Richard N. Anderson, Owensboro, Ky.

[73] Assignee: Hunter Douglas Inc., Totowa, N.J.

[21] Appl. No.: 603,844

[22] Filed: Apr. 25, 1984

[51] Int. Cl.[4] ..... E06B 9/264; E06B 3/34; E06B 7/086

[52] U.S. Cl. ..... 160/107; 49/64; 160/174; 160/176 R

[58] Field of Search ..... 160/107, 176, 174; 49/64

[56] References Cited

U.S. PATENT DOCUMENTS

| | | | |
|---|---|---|---|
| 2,854,102 | 9/1958 | Peeples | 160/107 |
| 3,210,809 | 10/1965 | Streeter, Jr. | 49/64 |
| 3,253,644 | 5/1966 | Gotoh et al. | 160/107 |
| 3,318,360 | 5/1967 | Persson | 160/107 |
| 3,703,920 | 11/1972 | Debs | 160/107 |
| 4,513,804 | 4/1985 | Anderson | 160/107 |

FOREIGN PATENT DOCUMENTS

| | | | |
|---|---|---|---|
| 89203 | 2/1953 | Norway | 160/107 |

*Primary Examiner*—Ramon S. Britts
*Assistant Examiner*—Cherney Lieberman
*Attorney, Agent, or Firm*—Pennie & Edmonds

[57] ABSTRACT

A glass spacer adapted for use in a window unit having two spaced glazings including a venetian blind assembly positioned between the glazings. The spacer includes a body member which extends between the slats parallel to the edges thereof and a privacy strip which extends substantially the length of the body portion and which is perpendicular to the body portion to overlap a portion of the slats of the blind assembly.

4 Claims, 5 Drawing Figures

GLASS SPACER CONSTRUCTION

FIELD OF THE INVENTION

This invention relates to a glass spacer construction adapted to separate parallel spaced glazings and more particularly to a spacer construction having a privacy strip thereon to mask off or close any opening or gap occurring between edges or ends of a venetian blind assembly positioned between the glazings and the edges of the glazings.

BACKGROUND OF THE INVENTION

Window units are known in which spaced glazings in the form of glass sheets are spaced apart and where a venetian blind assembly comprising a mat of tiltable slats is positioned between the glazings. The glazings are held in sashes and are spaced apart by spacers extending between the glazings along top and bottom edges of the glazings and side edges of the glazings. Window units incorporting such structure are usually insulated units so that the space between the glazings forms an insulation barrier to impede heat transfer between the glazings.

A problem which exists with such units is that when the slats of the blind assembly are tilted to a fully closed position, there often remains a slight gap between the top and bottom end slats and the top and bottom spacers and/or sashes of the window unit as well as a gap between the side edges of all the slats and side spacers and side sashes of the window unit.

These gaps, besides compromising privacy, may decrease the thermal effectiveness of the window unit and can in some instances result in the slats becoming jammed in a closed position. Such jamming can be particularly serious where a hermetically sealed unit is involved since the unit in most cases has to be replaced if already installed at a building site and returned to a factory for repair.

It is therefore an object of my invention to provide for a glass spacer which is easy to manufacture, may close or mask off any gaps between a venetian blind assembly and sashes of the window unit when the slats of the assembly are tilted to a closed position, which will increase thermal effectiveness of an insulated window unit, and which may serve to reduce any tendency of edges of a slat becoming wedged in a closed position by being caught between a glass sheet and a spacer or insulation member.

GENERAL DESCRIPTION OF THE INVENTION

Broadly a glass spacer constructed according to my invention is adapted for use in a window unit having two spaced glazings including a venetian blind assembly having a plurality of slats positioned between the glazings. The spacer includes a body member which extends between the glazings parallel to the edges thereof. This body portion has a privacy strip thereon which extends substantially the length of the body portion and perpendicular to the body portion so as to overlap a portion of the slats when in a fully tilted position in order to mask or close off any gap occurring between the body portion and the slats.

In one form of the invention the body portion extends parallel to the slats making up the blind assembly with the privacy strip overlapping an end slat of the mat of slats when the slats are in a tilted position. In this embodiment the strip, besides closing or masking off any gap to insure privacy, also acts to impede any convection flow of air from one side of the closed slats to an opposite side thus increasing efficiency of the insulation properties of a window unit. The privacy strip may include a bearing mounting means by which a pivot bearing member is pivotally mounted with respect to the glass spacer. The blind assembly in such a structure is supported by cord ladders which extend between two pivot bearing members located at opposite ends of the plurality of slats with at least one of the members being attached to a privacy strip. Preferably the opposite bearing member will also be attached to the privacy strip on a further glass spacer member. In this manner the venetian blind assembly is supported for tilting movement between the two glass spacers.

The privacy strip also preferably includes attachment means by which a spring member is held to the strip and where the spring pivotally supports a pivot member. The strip in this instance has a cutout therein to accommodate the pivot member.

In another form of the invention, the spacer has a privacy strip on each side edge of the spacer adapted to extend parallel to and adjacent to a glazing and beyond the edges of the slats to close or mask off any gap between the ends of the slats and the spacer. Further by having the ends of the strip extend beyond the slats even when the slats are moved to engage a spacer member on the opposite end of the glazings assures that the ends of the slats cannot become jammed in between a glazing and a spacer.

DESCRIPTION OF THE PREFERRRED EMBODIMENT

Figure 1:
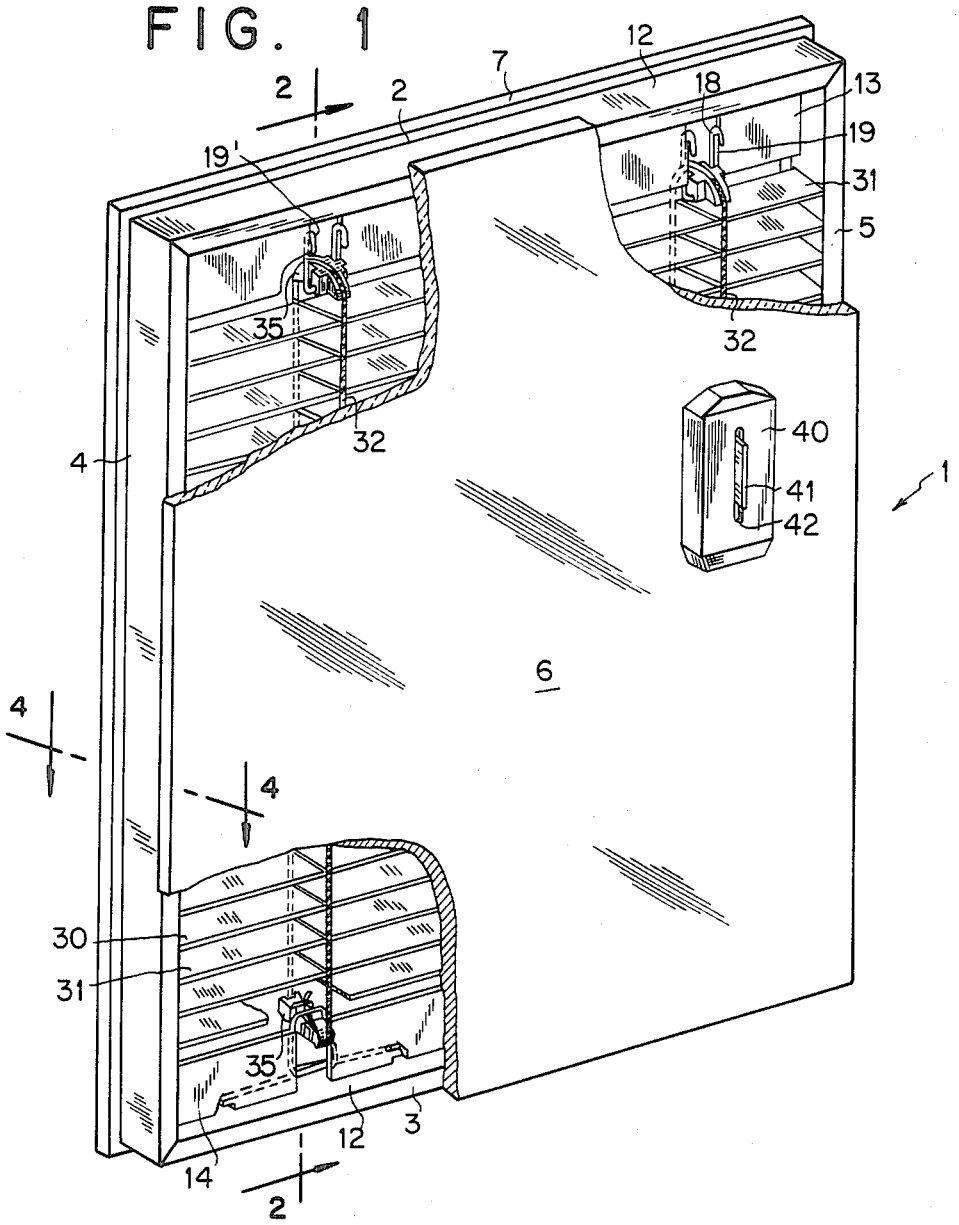
FIG. 1 is a perspective view of a window unit having glass spacers therein constructed according to the invention.
Figure 4:
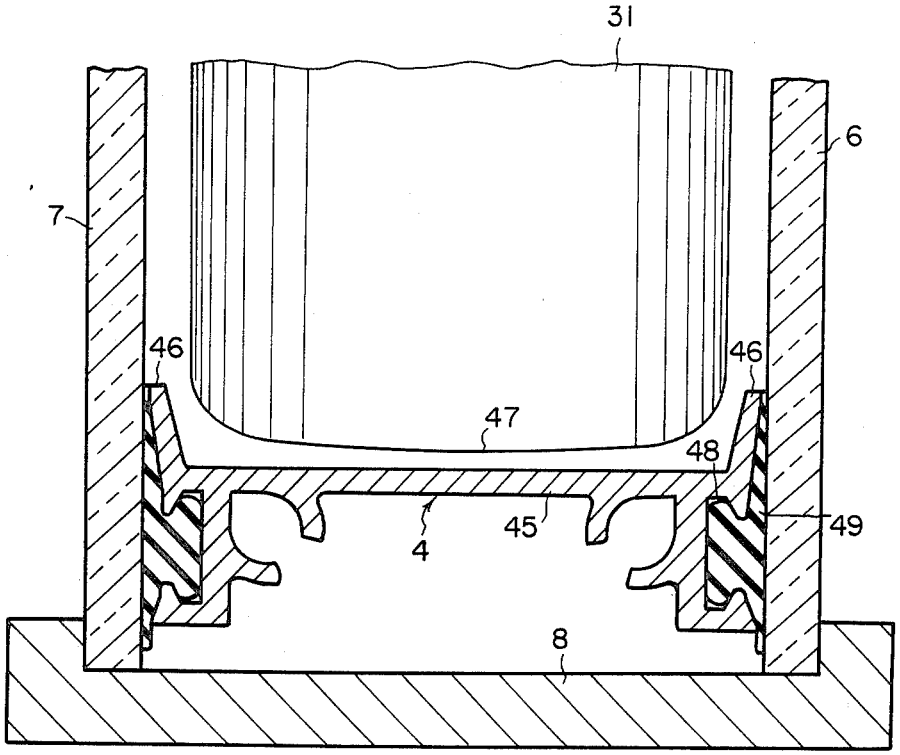
FIG. 4 is an enlarged sectional view of FIG. 1 taken along lines 4—4.
Figure 5:
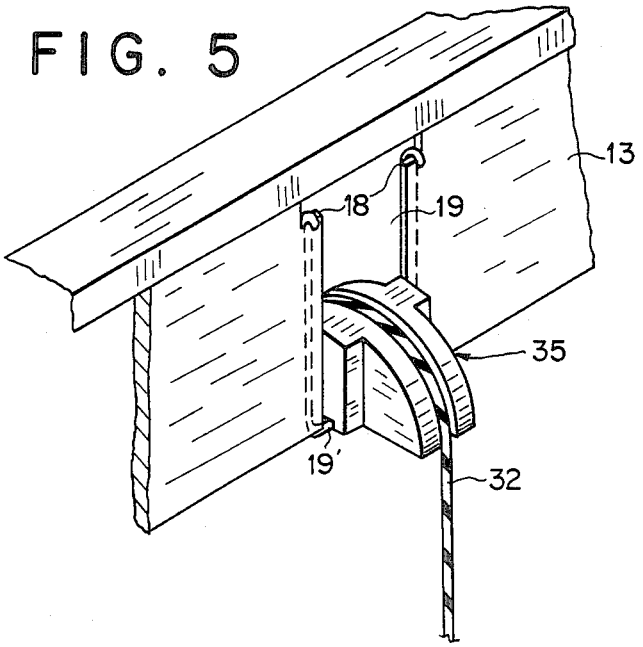
FIG. 5 is an enlarged view of a portion of the window unit shown in FIG. 2.

Referring to the drawings and particularly to FIG. 1, there is illustrated a window unit 1 having upper and lower glazing spacers 2 and 3 joined by side glazing spacers 4 and 5. The unit is double-glazed and includes glazings 6 and 7 contained in sashes 8, one of which is shown in FIG. 4, which are adapted to be attached to frame members, not shown, surrounding the window unit.

A venetian blind assembly 30 is positioned between the glazings and comprises a plurality of slats 31 which form a mat of slats and which are tiltably supported by cord ladders 32 which are in turn suspended between pivot bearings 35 positioned adjacent the top and bottom ends of the mat of slats and whch are in turn, as more fully explained hereafter, pivotally mounted with respect to the upper and lower spacers.

The slats may be tilted by means of an operable element 40 which comprises a magnetic housing containing magnets (not shown) and which may slide linearly in a vertical direction on the glazing 6. The operable element 40 is magnetically coupled to an operating element, not shown, positioned on the opposite side of the glazing 6 and which is also linearly movable in a vertical direction. This operating element is connected to a cord ladder 32 such that when the operating element 40 is moved vertically, the operating element also moves to in turn move the ladder cord to cause tilting of all of the slats. A stroke limiter 41 is affixed to the surface of the glazing 6 and extends through a slot 42 of the operating element to guide the element in a linear direction.

The spacers 2 and 3 each include a body portion 12 which extends between the glazings parallel to the upper and lower edges of the glazings substantially along the complete length of the glazing. The upper spaceer 2 includes a privacy strip 13 while the lower spacer 3 includes a privacy strip 14 which overlap the upper and lower end slats of the mat of slats when the slats are in a fully tilted position. The strips 13 and 14, besides closing or masking off any gap that may exist between the upper and lower end slats of the mat of slats and the body portions 12 of the spacer members so as to assure complete privacy, also act to reduce any convection flow of air that may occur between the two glazings. which would increase heat transfer and thus reduce efficiency of the insulation qualities of the window unit.

Figure 3:
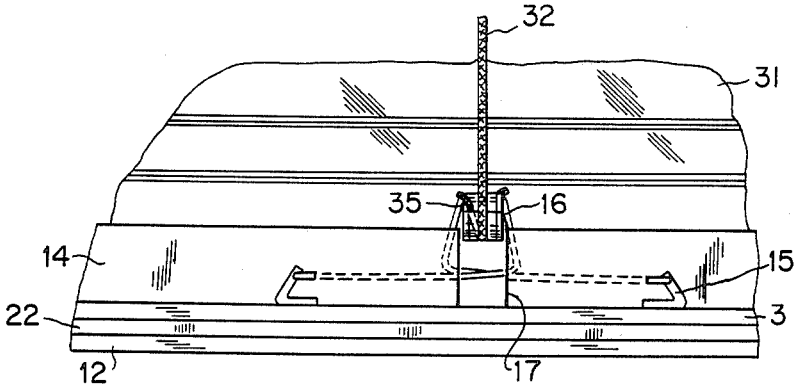
FIG. 3 is an enlarged view of a portion of the window unit of FIG. 2.
Figure 2:
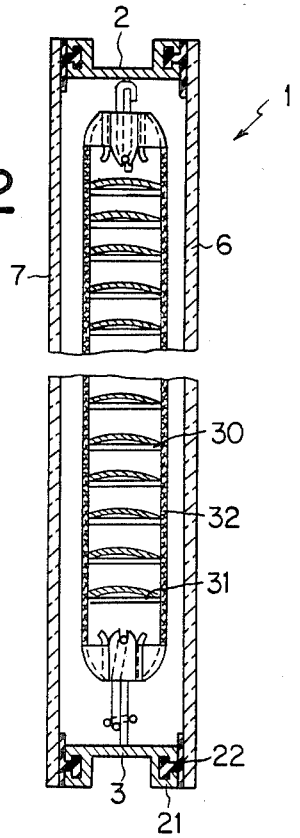
FIG. 2 is a sectional view of the unit of FIG. 1 taken along lines 2—2.

As shown in FIG. 3 the privacy strip includes attachment means 15 in the form of slits by which a spring member 16 may pivotally mount a pivot bearing member 35. The spring mounting 16 assures that the ladder cord 32 are maintained under tension. The strip 14 includes a cutout 17 to accommodate the pivot means 35.

The privacy strip 13 of the upper spacer element 10 may be identical to that of strip 14 of the lower spacer element or as shown in FIG. 1, may include a shoulder 18 in a cutout 19 therein to mount a wire hanger 19' which pivotally mounts the pivot means 35.

The upper and lower spacers may include conventional grooves 21 into which plastic or rubber insulation strips 22 may be inserted to provide a seal and heat barrier between the glazings and the spacers. This construction is particularly adaptable for use with hermetically sealed window units.

Referring to FIG. 4 the side spacer element 4 includes a body portion 45 having a privacy strip 46 extending in a direction parallel to the slats and positioned at each end of the body portion. Each privacy strip 46 extends beyond the ends of the slats 31 even when the ends of the slats engages the opposite spacer 5 positioned on the opposite side of the window unit. This construction assures that an end 47 of a slat will not become caught or jammed between a glazing and an end of a privacy strip when the slats are tilted to a fully closed position. If this were to occur, the slats could be locked in the fully closed position necessitating disassembly of the window unit in order to repair or replace the same.

The spacer 3 includes the customary grooves 48 to accommodate insulation strips 49 in the same general manner as with the insulation strips installed with the upper and lower glass spacers.

The spacer 5 on the opposited side of the window unit is identical with spacer 4.

While I have described the window unit as having upper and lower portions, it is apparent that the unit could be rotated 90° so that the slats extend vertically without any change of construction particularly with respect to the glass spacers.

It is seen that glass spacers constructed according to the invention will provide complete privacy when the slats of a blind assembly are tilted to a fully closed position in that the privacy strips associated with the spacers will mask off or close any gap occurring between the edges of the mat of slats and the body portion of the glass spacers.

I claim:

1. A glass spacer construction adapted to be positioned in a window unit containing two spaced glazings having a venetian blind assembly comprising a mat of tiltable slats having an end slat at either end thereof, said mat being mounted between said glazings and where the spacer construction includes a body portion adapted to extend between and parallel to the edges of said glazings to maintain spacing therebetween, characterized in that said body portion has a privacy strip thereon extending substantially the length thereof and substantially perpendicular thereto at a position on said body extending between and spaced from each glazing with said strip overlapping a portion of at least one of said end slats to close off any spacing between said body portion and said at least one of said end slats when said slats are in tilted position, and further characterized in that said mat of slats is tiltably supported by suspension means connected to and extending between pivot bearing members, and in that said privacy strip includes bearing mountings therein for pivotally mounting a pivot bearing member.

2. A glass spacer construction according to claim 1 further characterized in that said strip has a cutout therein adapted to receive a pivot bearing member and attachment means by which a spring member mounting a pivot bearing member may be fastened to said strip.

3. A window unit comprising at least two spaced glazings having a venetian blind assembly comprising a mat of tiltable slats having an end slat at either end thereof, said mat being mounted between said glazings and including at least one glass spacer construction between said glazings, characterized in that said spacer contruction has a body portion extending between and parallel to the edges of said glazing and a privacy strip on said body portion extending substantially the length thereof and substantially perpendicular thereto at a position on said body portion extending between and spaced from the glazings, said strip overlapping a portion of at least one of said end slats to close off any spacing between said body portion and said at least one of said end slats when said slats are in tilted position and further characterized in that said mat of slats is tiltably supported by suspension means connected to and extending between pivot bearing members, and in that said privacy strip includes bearing mountings therein for pivotally mounting a pivot bearing member.

4. A window unit according to claim 3 further characterized in that said slats have parallel longitudinal axes disposed in a plane extending centrally of said mat and said body portion extends parallel to the longitudinal axes of said slats and wherein said privacy strip is disposed in said plane to overlap an end slat of the mat of slats when the slats are in a tilted position to close off any spacing between said end slat and said body portion.

* * * * *